US005276413A

United States Patent [19]

Schulze-Buxloh

[11] Patent Number: 5,276,413

[45] Date of Patent: Jan. 4, 1994

[54] HIGH FREQUENCY RADIATION CABLE INCLUDING SUCCESSIVE SECTIONS HAVING INCREASING NUMBER OF OPENINGS

[75] Inventor: Karl Schulze-Buxloh, Monchen-Gladbach, Fed. Rep. of Germany

[73] Assignee: Kabelrheydt Aktiengesellshaft, Fed. Rep. of Germany

[21] Appl. No.: 845,062

[22] Filed: Mar. 3, 1992

[30] Foreign Application Priority Data

Mar. 5, 1991 [DE] Fed. Rep. of Germany ..... 4196890

[51] Int. Cl.[5] ..... H01Q 13/20

[52] U.S. Cl. ..... 333/237; 343/770

[58] Field of Search ..... 333/237; 343/770; 340/552, 553; 455/55, 41; 379/55

[56] References Cited

U.S. PATENT DOCUMENTS

| | | | |
|---|---|---|---|
| 2,756,421 | 7/1956 | Harvey et al. | 343/770 |
| 3,781,725 | 12/1973 | Yoshida et al. | 333/237 |
| 4,152,648 | 5/1979 | Delogne | 333/237 X |
| 4,322,699 | 3/1982 | Hildebrand et al. | 333/237 |
| 4,325,039 | 4/1982 | Allebone | 333/237 |

*Primary Examiner*—Benny T. Lee

*Attorney, Agent, or Firm*—Ware, Fressola, Van Der Sluys & Adolphson

[57] ABSTRACT

In a high frequency radiation cable, with groups of openings arranged periodically in the outside conductor of a coaxial cable, the number of openings per periodic length increases in sections along the cable, where the sections are whole number multiples of the periodic length.

17 Claims, 3 Drawing Sheets

HIGH FREQUENCY RADIATION CABLE INCLUDING SUCCESSIVE SECTIONS HAVING INCREASING NUMBER OF OPENINGS

BACKGROUND OF THE INVENTION

1. Field of the Invention

The invention concerns a high frequency radiation cable, and more particularly, a high frequency radiation cable with groups of periodically arranged openings in the outside of the conductor cable.

2. Description of the Prior Art

A radiation cable or a leakage cable is a waveguide made from a coaxial cable, which has openings in periodic sequence on the outside conductor. Electromagnetic fields pass through these openings into the outer cable space. The output to be radiated is supplied at one end of the cable. Because of natural cable attenuation, the intensity of the radiated output decreases along the length of the cable. In practice, this means that the sum of line and coupling attenuation between a vehicle and the radiating wave guide increases with the distance of the vehicle from the high frequency supply point. It would therefore be desirable to vary the energy coupling along the wave guide or the cable, so that the received field strength is kept constant in the mobile component.

A leakage cable is known from European patent application EP 188 347, wherein the outside conductor of the coaxial cable consists of bands surrounding the central conductor in a helix, and which overlap so as to form diamond-shaped gaps. These gaps get larger at the end of the cable, i.e. with increasing distance from the supply point, so that more energy can be radiated.

The disadvantage of this process, in addition to the high cost, is that enlarging the openings or holes only produces a relatively small increase in radiation.

SUMMARY OF THE INVENTION

An object of the invention therefore is to produce a high frequency radiation cable, in which the losses along the length of the cable can be balanced in simple form, so that the received field strength remains approximately constant along the cable.

It has now been found that the foregoing object can be readily attained in a high frequency radiation cable with groups of periodically arranged openings in the outside conductor of a coaxial cable. The number of openings per periodic length increases in sections along the cable, where the sections are whole number multiples of the periodic length. The increase in the number of openings per periodic length along the cable nearly balances any decrease in radiation output caused by line attenuation as a function of distance of a mobile receiver from a supply point where HF energy is fed into the cable.

Desirably, the number of openings doubles by sections, so that the number of openings per periodic length is $2^{n-1}$ in the nth section of the cable, where $n=1, 2, 3, 4 \ldots$. The nth section of the length is so dimensioned, that, when the radiation output decreases, the increase in the number of openings per periodic length in the nth+1 section, raises the value of the radiation output to what it was at the start of the nth section. The number of openings per periodic length in each section along the cable increases by a certain number k(n).

Ideally, the first section of the cable has only one opening per period. In the transition from one to several openings per periodic length, the openings in each period are arranged between the former openings, so that no periodicity is created in the arrangement.

According to the invention, the openings have an elongated shape, with the largest dimension of each opening placed normal to the cable axis. In another feature of the invention, all openings have the same shape. The area of each opening can be increased with distance from the supply point where HF energy is fed into the cable.

In still another feature, two or more rows of openings with different periodic lengths are provided along different jacket lines of the cable. The rows differ in periodic length from jacket line to jacket line for transmitting several frequency bands.

Above all, the invention finds application in tunnels that are equipped with high frequency radiation through a radiation cable, for the transmission of information. Another application is along streets and highways for which traffic guidance technology is provided. The solution according to the invention refers to the transmission of information over relatively narrow bands.

BRIEF DESCRIPTION OF THE DRAWINGS

The invention can be better understood of the drawings, where.

DETAILED DESCRIPTION OF THE INVENTION

The so-called D-network signifies a new generation in mobile radio telephone systems following the former generations A, B and C and uses frequencies of 925±35 MHz. A simple radiation cable for transmitting this range comprises a coaxial cable, with an opening placed at twenty-five centimeter intervals in the outside conductor. This produces a useful bandwidth of 600–1,100 MHz.

Since special measures to suppress harmonic waves are not required, the arrangement of the openings provides some degree of freedom in placing the number of openings per periodic length, which can be utilized in this instance to compensate for the attenuation. A commercial coaxial cable (⅞ inch) has a wave attenuation of about 3.7 to 3.9 dB/100 m, between 890 and 960 MHz. This coaxial cable can be transformed into a radiation or leakage cable, for example by installing equal size openings at equal distances of 25 cm from each other. The radiation of such a cable decreases along its length, when viewed from the point at which the HF energy is supplied.

The coupling attenuation in an "unslit" coaxial cable would be "infinitely" large, (because the antenna running parallel to the cable cannot receive "anything"), and the wave attenuation is about 3.7 dB/100 m. In a leakage cable with an opening of 20×3 mm² per periodic length of about 25 cm, the coupling attenuation between leakage cable and mobile antenna is about 95 dB at a distance of several meters from the center, and the wave attenuation is 4.0 dB/100 m. Because of the linear increase in wave attenuation with cable length at constant operating frequency, the signal at the end of the leakage cable is weaker by the wave attenuation in relation to the cable length. This refers to the signal near the supply point, where almost no wave attenuation takes place.

This decrease in radiation output has now been balanced, so that the so-called system value, as the sum of coupling and wave attenuation, is as constant as possible along the length of the leakage cable. This can be achieved by successively increasing the radiation with increasing cable length. In turn, this increase in radiation increases wave attenuation, so that the compensation toward the end of the cable requires the number of openings to increases sharply.

To obtain the most favorable arrangement of openings one starts with one opening per periodic length and doubles their number, as soon as the line attenuation has increased by a value determined through measurements, for example by 5.6 dB. It was determined from the theory and subsequent measurements, that the increase in radiation, when the number of openings per unit of length is doubled, does not quite reach a factor of 2, or 6 dB, but only about 5.6 dB. This value is an average of measurement data in the D-network, at a frequency of 890 to 960 MHz.

Figure 1:
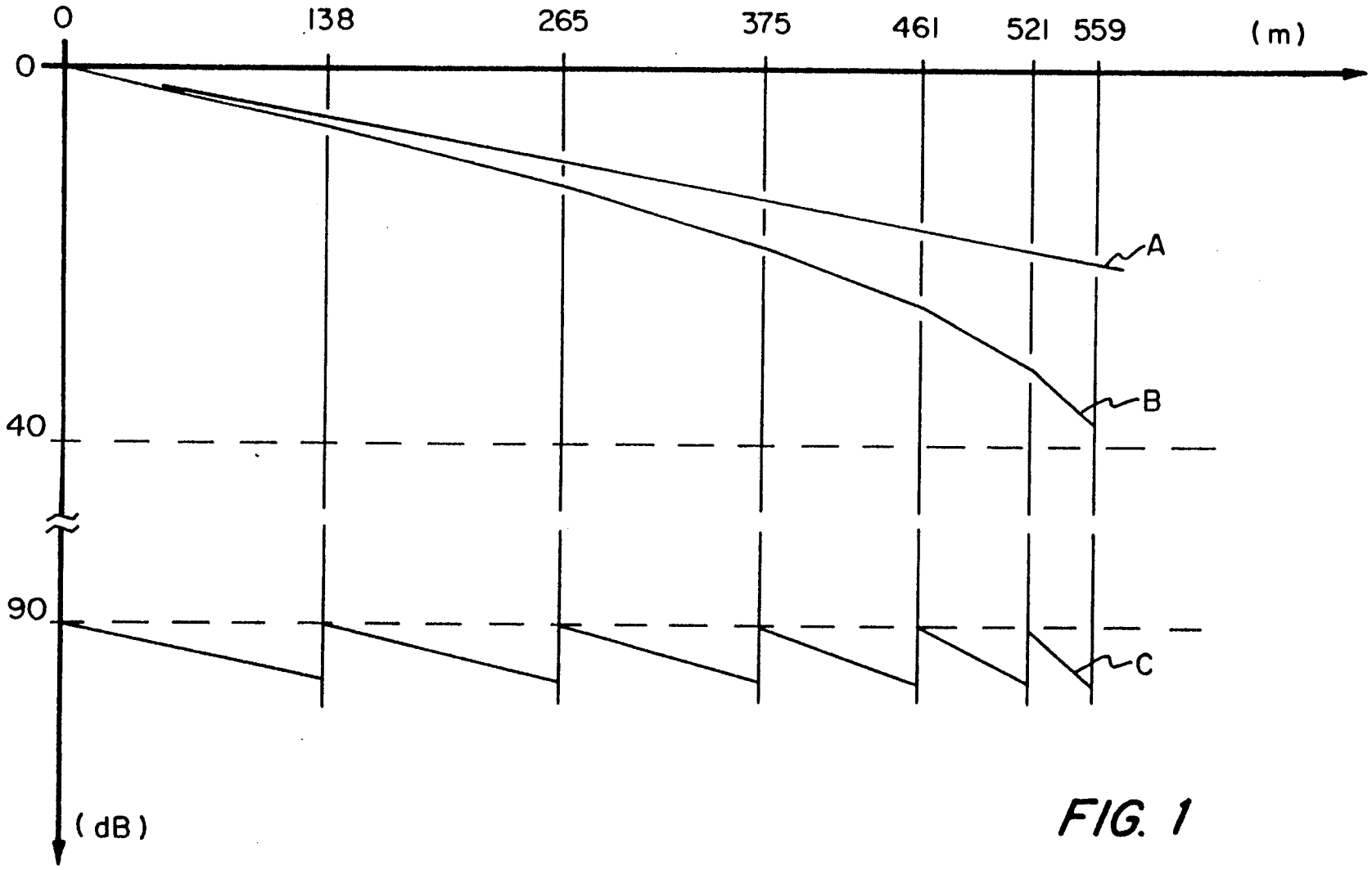
FIG. 1 shows the attenuation process along the cable.

In FIG. 1, these relationships have been represented as examples in a 560 m long coaxial cable. The straight line A represents line attenuation of the cable without openings, while curve B shows the (theoretic) line attenuation with openings, each as a function of distance from the point where the signal is supplied at the beginning of the cable. The lower portion of FIG. 1 represents the sum of coupling and line attenuations. Curve B decays more rapidly due to the additional radiation losses. With an arrangement of one opening per 25 cm, the value of about 3.7 dB/100 m at an operating frequency of 900 MHz increases by about 0.35 dB/100 m, because of the radiation. Thus, the line attenuation is about 4.05 dB/100 m.

Therefore, if one wishes for example to compensate for the line attenuation by doubling the number of openings, this configuration is only needed after a cable length of more than 130 m. This increase in the number of openings raises the system value, as the sum of coupling and line attenuations, to the old value of 90 dB e.g., as can be seen in curve C. From then on, line attenuation decreases somewhat more rapidly according to curve B. Doubling the number of openings also increases the attenuation due to radiation losses, from about 0.35 dB/100 m to about 0.7 dB/100 m. So strong an increase in attenuation is again measured after about 130 m of cable length, that the number of openings soon needs to be doubled again, to maintain the old system value of about 90 dB. Thus, there are 4 openings per periodic length in the third section, and 8 in the fourth. This always balances the attenuation losses, as can be seen in curve C. The section lengths decrease, because of the ever heavier radiation losses. This is shown in curve B, which declines ever more sharply towards the end.

The following table shows, in an example for about 900 MHz, how the length of the individual sections depends on the number of openings.

TABLE I

| Section Name | Section Number (n) | Number of Slits/Openings per Periodic Length (P) | Length of Section (L) |
|---|---|---|---|
| Section A1 | 1 | 1 | 138 m |
| Section A2 | 2 | 2 | 127 m |
| Section A3 | 3 | 4 | 110 m |
| Section A4 | 4 | 8 | 86 m |
| Section A5 | 5 | 16 | 60 m |
| Section A6 | 6 | 32 | 38 m |

In a first approximation, the length of the sections is calculated by the following:

$$L = 100 \times \frac{\text{Change in radiation (dB)}}{\text{Attenuation (dB/100m)}}$$

where the units are:

m = meters dB = decibels dB/100 m = decibels per 100 meters.

This was essentially confirmed by measurements. The measurements revealed signal fluctuations with a standard deviation of ±5 dB. The change in radiation in each case is about 5.6 dB while the attenuation is about $3.7+(2^{n-1})\times 0.35$ dB/100 m, where n is the nth section in the range n = 1, 2, 3, 4, . . . .

Measurements have shown that the estimated lengths of the individual sections were relatively accurate. The first section of the frequency band in this instance can be a little longer, before a doubling or other increase in the number of openings is needed.

The second and the other openings, which are added to each new section, may not be installed in the middle between existing openings, so as to not divide the periodic length in half, and therefore radiate only starting with the doubled frequency $2f_o$. Otherwise, the situation has not been determined. As many openings as are needed are installed for the compensation.

Of course, other frequency bands may be transmitted, where the periodic length P is chosen, so as to adapt to the lower limit frequency $f_o$ of the transmitted frequency band. Aside from doubling the number of openings, other algorithms may be used to increase their number. For example, instead of a factor of 2, an increase by a factor of 3. It is a simple matter to double the number of openings, and the achieved attenuation balance is sufficient for practical applications.

Figure 2:
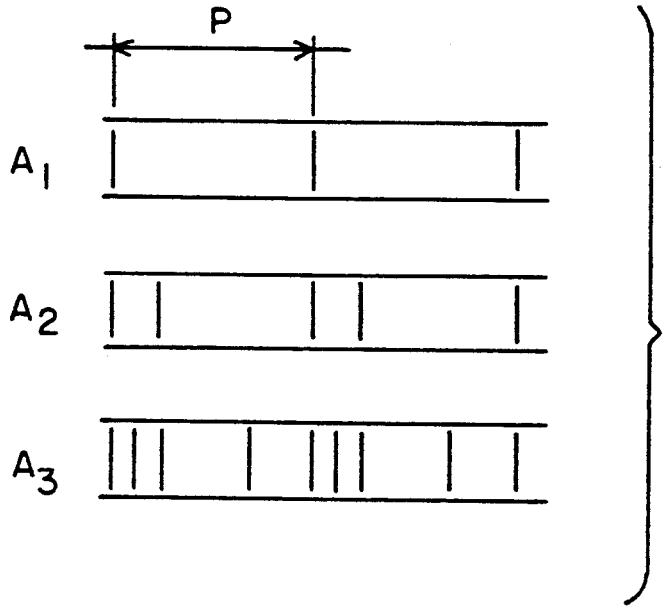
FIG. 2 shows the arrangement of the openings in the first several sections, and a further example of an arrangement of openings in periodic intervals.

FIG. 2 compares the openings (represented by the vertical lines in the different sections A1–A3. Each periodic length P has a designated number of openings therein.

Figure 3:
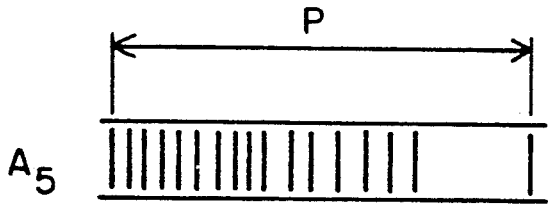
FIG. 3 shows a possible arrangement of openings in the fifth section of the cable.

FIG. 3 shows section A5 which has 16 openings per period. Each vertical line represents an opening. This relatively irregular arrangement of 16 openings is intended for the fifth section P. Each vertical line represents an opening. Care must be taken to avoid a series of openings with half the periodic length.

Figure 4:
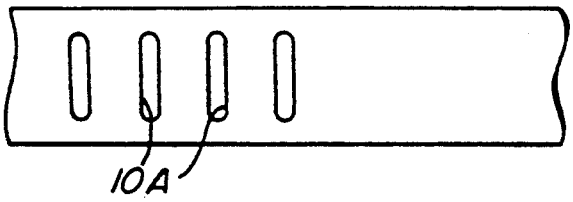
FIGS. 4–7 are side elevational views of cables having various arrangements of openings.
Figure 5:
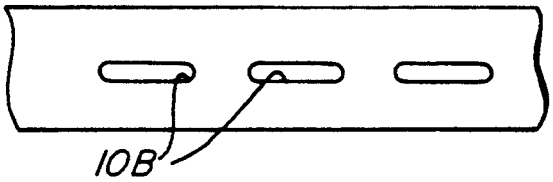
Figure 6:
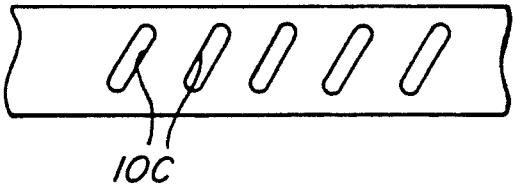
Figure 7:
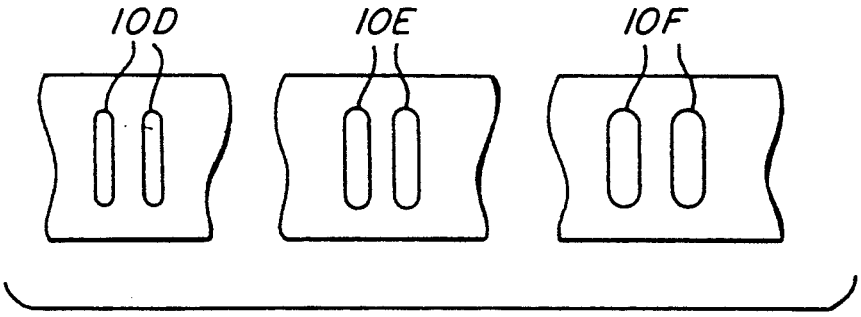

As shown in FIGS. 4–6, the openings (10A, 10B, 10C) can have the same elongated shape. The openings (10A, 10B, 10C) can be placed normal, parallel or obliquely to the cable axis in a row along a jacket line. Referring to FIG. 7, instead of having the same size, the area of each opening (10D, 10E, 10F) can increase with the distance from the supply point to the left of openings 10D where the HF energy is fed into the cable. The openings are preferably made by punch-stamping the outside conductor, which can then be cylindrically formed around the internal insulator, and welded or overlapped and glued.

Figure 8:
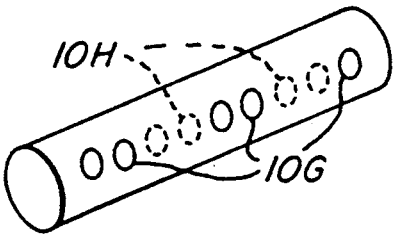
FIGS. 8–9 are perspective views of cables having various arrangements of openings.
Figure 9:
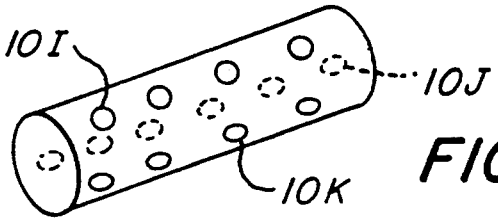

As shown in FIG. 8, it is also possible, of course, to provide two different opening arrangements—one set of openings 10G on the front side, the other set of openings 10H on the back side of the cable. Selecting the corresponding periodic lengths makes it possible to transmit different frequency bands in this manner. FIG. 9 shows that it is possible to use more than two rows of openings (10I, 10J, 10K) spaced around the circumference of the cable.

Because of the reciprocity theorem, all the above configurations also have analog application when the direction of transmission is reversed. This means that, in the case of a mobile transmitting component, a receiver connected to a cable configured according to the invention, receives signals of uniform intensity, regardless of the mobile transmitter's position.

What is claimed is:

1. A high frequency radiation cable comprising:

a coaxial cable with outside and inside conductors and having a periodic length, associated therewith, the coaxial cable comprising of a plurality of sections therealong where the sections have respective lengths which are whole number multiples of the periodic length, a group of openings in the outside conductor in each of the sections of the coaxial cable, each group of openings having a number of openings per periodic length, the number of openings per periodic length increases in each successive section along the cable.

2. A high frequency radiation cable according to claim 1, wherein each opening defines a respective area, said respective areas increasing along the coaxial cable.

3. A high frequency cable according to claim 1, wherein the openings have an elongated shape.

4. A high frequency radiation cable according to claim 3, wherein the coaxial cable has a cable axis and each opening having a largest dimension placed normal to the cable axis.

5. A high frequency radiation cable according to claim 1, wherein the number of openings per periodic length increases in each successive section, so that the number of openings per periodic length is $2^{n-1}$ in an nth section of the cable, where n=1, 2, 3, 4, . . . .

6. A high frequency radiation cable according to claim 3, wherein a first section of the cable has only one opening per periodic length.

7. A high frequency radiation cable according to claim 6, wherein in sections subsequent to the first section, the openings are arranged to maintain the periodic length.

8. A high frequency radiation cable according to claim 7, wherein the openings have an elongated shape.

9. A high frequency radiation cable according to claim 8, wherein the coaxial cable has a cable axis and each opening having a largest dimension placed normal to the cable axis.

10. A high frequency radiation cable according to claim 9, wherein all openings are identically shaped.

11. A high frequency radiation cable according to claim 10, wherein each opening defines a respective area, said respective areas increasing along the coaxial cable.

12. A high frequency radiation cable according to claim 1, wherein all openings are identically shaped.

13. A high frequency radiation cable according to claim 1, wherein the number of openings per periodic length in each successive section along the cable increases, such that the successively increasing number of openings per periodic length is a function of the particular section.

14. A high frequency radiation cable according to claim 1, wherein a first section of the cable has only one opening per periodic length.

15. A high frequency radiation cable according to claim 14, wherein in sections subsequent to the first section, the openings are arranged to maintain the periodic length.

16. A high frequency radiation cable for transmitting multiple frequency bands comprising:

a coaxial cable with outside and inside conductors and having a first and second periodic lengths, associated therewith the coaxial cable comprising of first and second plurality of sections extending concurrently therealong where the section of the first plurality have respective lengths which are whole number multiples of the first periodic length and the sections of the second plurality have respective lengths which are whole number multiples of the second periodic length, a group of openings in the outside conductor in each of the sections of the first plurality of sections, each group of openings in the sections of the first plurality of sections being provided along a first row and having a specified number of openings corresponding to the first periodic length, the specified number of openings in the first plurality of sections increases in each successive section of the first plurality along the cable, each group of openings in the sections of the second plurality of sections being provided along a second row and having a number of openings corresponding to the second periodic length, the specified number of openings in the second plurality of sections increases in each successive section of the second plurality along the cable.

17. A high frequency radiation cable according to claim 16, wherein the coaxial cable further includes a third plurality of section extending concurrently with the first and second plurality of sections and having a third periodic length associated therewith, the sections of the third plurality have lengths which are whole number multiples of the third plurality length, a group of openings in the outside conductor in each of the sections of the third plurality of sections being provided along a third row and having a number of openings corresponding to the third periodic length, the specified number of openings in the third plurality of sections increases in each successive section of the third plurality along the cable.

* * * * *

UNITED STATES PATENT AND TRADEMARK OFFICE

CERTIFICATE OF CORRECTION

PATENT NO. : 5,276,413

DATED : January 4, 1994

INVENTOR(S) : Karl Schulze-Buxloh

It is certified that error appears in the above-identified patent and that said Letters Patent is hereby corrected as shown below:

On the title page,
Item (30) Foreign Application Priority Data

"Mar. 5, 1991 (DE) Fed. Rep. of Germany ..... 4196890"

should be:

--Mar. 5, 1991 (DE) Fed. Rep. of Germany ..... 4106890--.

Signed and Sealed this

Fourteenth Day of June, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,276,413

DATED : January 4, 1994

INVENTOR(S) : KARL SCHULZE-BUXLOH

It is certified that error appears in the above-indentified patent and that said Letters Patent is hereby corrected as shown below:

Column 5, line 23, first occurrence of "," should be deleted
Column 5, line 48, "3" should be --5--;
Column 6, line 23, after "lengths", "," should be deleted;
Column 6, line 24, after "therewith", --,-- should be inserted.

Signed and Sealed this

Twentieth Day of June, 1995

*Attest:*

Bruce Lehman

BRUCE LEHMAN

*Attesting Officer*

*Commissioner of Patents and Trademarks*